US005314582A

United States Patent [19]

Nguyen et al.

[11] Patent Number: 5,314,582

[45] Date of Patent: May 24, 1994

[54] CELLULOSIC FIBER OF IMPROVED WETTABILITY

[75] Inventors: Hien V. Nguyen, East Windsor; Cecilia Vargas, Colonia, both of N.J.

[73] Assignee: Chicopee, Milltown, N.J.

[21] Appl. No.: 918,321

[22] Filed: Jul. 22, 1992

[51] Int. Cl.[5] ..... D21H 17/63

[52] U.S. Cl. ..... 162/9; 162/100; 162/148; 162/181.2; 162/182

[58] Field of Search ..... 162/181.2, 9, 182, 201, 162/100, 148

[56] References Cited

FOREIGN PATENT DOCUMENTS 1193808 9/1985 Canada ..... 162/181.2

*Primary Examiner*—Peter Chin

*Attorney, Agent, or Firm*—Lawrence D. Schuler

[57] ABSTRACT

A cellulosic fiber of improved wettability comprising cellulosic fibers with small discrete crystal domain of ionic salt attached to the surface of the fiber. The method of making the cellulosic fiber of improved wettability is also claimed.

6 Claims, 2 Drawing Sheets

CELLULOSIC FIBER OF IMPROVED WETTABILITY

The invention relates to a cellulosic fiber of improved wettability comprising cellulosic fiber with discrete crystals of ionic salt attached to the surface thereof. The method of making these cellulosic fibers of improved wettability is also provided.

BACKGROUND OF THE INVENTION

Cellulosic fibers find wide usage in products which require absorbency. Ground wood pulp fibers, for example, are used extensively in the absorbent cores of disposable diapers, sanitary napkins, incontinent devices and the like. Cellulose material obtains its absorbent property from the existence of polar hydroxy groups on the cellulose molecule. However, the hydrophilicity of cellulosic fibers is not 100%. This is partially due to the lack of complete accessibility of the hydroxy groups on the fiber surfaces and partially due to the existence on the surface of at least some cellulosic fibers of hydrophobic materials, such as fatty acids.

The absorbent core of many dressings, sanitary protection pads etc. comprise ground wood pulp cellulosic fibers. When the fluid to be absorbed is blood or menstrual fluid, the viscosity of the fluid is higher, and hence the transport of fluids within the absorbent core is slower than with a fluid of lesser viscosity. In the present invention, the salt present at the edge of the advancing fluid will increase the ionic strength of the fluid and thus decrease the viscosity of the fluid. This viscosity reduction will enhance the wicking rate or fluid travel in the absorbent product.

In those products in which a superabsorbent polymer is admixed with cellulosic fiber to form an absorbent core, there is competition for any applied liquid between the superabsorbent and the capillary network of the cellulosic fiber. The capillary force provided by the cellulosic fiber tries to move the liquid away from the impact zone of, for instance, a disposable diaper, while the superabsorbent tries to immobilize the fluid. If the superabsorbent swelling is dominant too early, most of the fluid will be immobilized at or near the impact zone while the rest of the absorbent material remains unused or dry. In the worse case, the impact zone can be so swollen so as to prevent capillary transport of the liquid away from the impact zone. The presence of an ionic salt causes the superabsorbent to take up fluid and thus swell and gel at a much slower rate which allows time for the capillary structure of the cellulosic fibers to move the liquid away from the impact zone into other areas of an absorbent core. Hence, the efficacy of the absorbent cores is increased.

It is therefore an objective of the present invention to provide a more wettable cellulosic fiber.

It is a further objective to provide a cellulosic fiber which has the propensity to reduce the viscosity of blood and menstrual fluid and hence provide an improved absorbent media for use in bandages, dressings and sanitary protection devices.

It is yet another objective of this invention to provide a cellulosic fiber which when used in an absorbent media in combination with a superabsorbent polymer causes the superabsorbent polymer to absorb liquid more slowly and allows for greater fluid spread within the absorptive media, hence increasing the efficacy of the absorbent media.

BRIEF SUMMARY OF THE INVENTION

This invention provides a cellulosic fiber of improved wettability. The cellulosic fiber has discrete crystal domains of ionic salt attached to its surface. The method of making this cellulosic fiber of improved wettability is also provided.

The cellulosic fiber of improved wettability finds use in the absorbent cores of dressings, bandages, sanitary protection devices and the like.

THE PRIOR ART

European Patent Application 83303098 entitled "Silica-Coated Absorbent Fibers and Processes for Their Manufacture" suggests the use of colloidal silica to coat a layer of silica on fibers so as to improve the hydrophilicity and therefore the wicking properties in a fiber web. One of the objectives of the invention is to improve the wettability of cellulosic fibers.

U.S. Pat. No. 4,548,847 entitled "Delayed-Swelling Absorbent Systems", issued to G. M. Aberson claims ionic cross-linking to permanently reduce the ability of superabsorbent to swell.

DETAILED DESCRIPTION OF THE INVENTION

Figure 1:
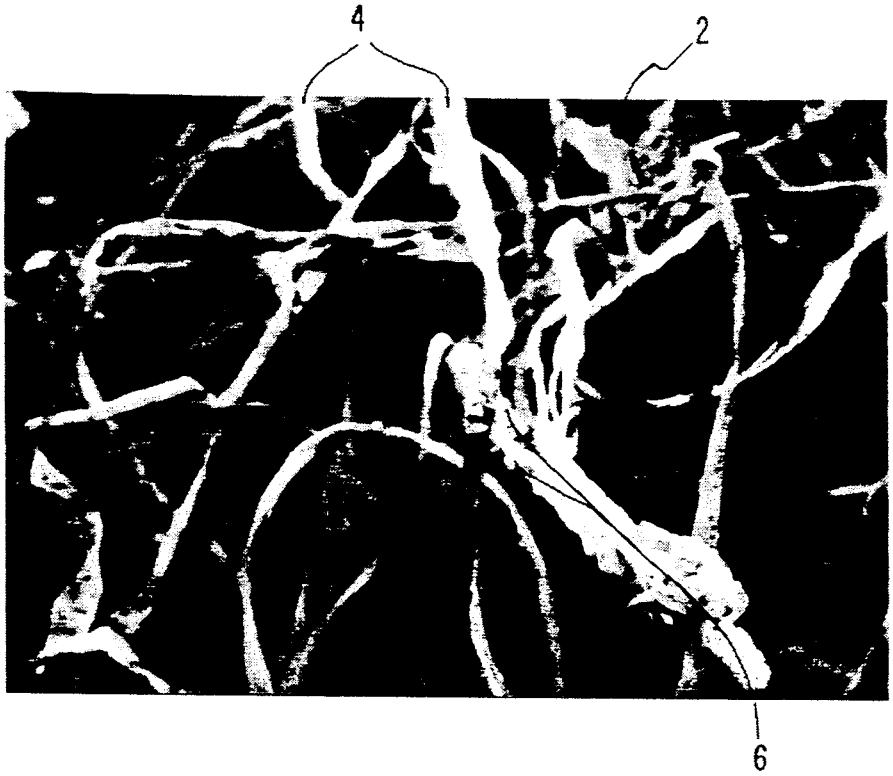
FIG. 1 is a photomicrograph of a cellulosic fiber at a magnification of 100X which shows the discrete salt domains affixed to the surface of the fiber.

In accordance with this invention, a cellulosic fiber of improved wettability is provided by affixing small discrete ionic salt crystal domains to the surface of the fiber The fiber used may be any hydrophilic fiber such as bagasse, bamboo, cotton, flax, hemp, jute, kapok, ramie, reed, sisal, straw, viscose rayon or wood pulp. The preferred fiber is viscose rayon and wood pulp. The fiber may be long or short. Textile length fibers of three quarters of inch ($\frac{3}{4}$") or longer may be used as may short paper making fibers of three quarters inch ($\frac{3}{4}$") or less. Ground wood pulp fibers of one quarter inch ($\frac{1}{4}$") or less are most useful in this invention.

The salt to be deposited on the surface of the fiber may be any salt of an ionic nature. The cation may be, for example, sodium, potassium ammonium, lithium etc.. The anion may be the halides such as chloride, bromide, fluoride, etc. or organic such as acetate, benzoate, citrate, salicylate, etc.. Sodium or potassium chloride is the preferred salt due to ease of handling and low cost. The salts are made up in a water solution.

It is most desirable to obtain a multiplicity of microscopic discrete crystals of salt on the surface of each fiber rather than a few large or agglomerated crystals. Small crystals are obtained by using rapid drying methods using high temperature and high volume air flows. Fine inert particles such as silica, diatomaceous earth, high molecular weight starch particles etc. may be added to the salt solution so that on application to the fiber nucleating sites for crystallization of the salt are provided. This technique helps insure the formation of microscopic discrete crystal domains.

Within the scope of this invention is the use of mixed salts. For example, with two cations and two anions, four different salts are possible. The different salts will crystallize separately lessening the chance of large homogeneous crystals.

The salt solution is preferably added to the fibers by spraying. An alternate method is to saturate a pulp fiber board by dipping the pulp fiber board into the salt solution, dewatering the board as by suction extraction and drying the board. The board is then ground to individualize the fibers and the ground wood pulp fibers collected to form a wood pulp batt. The salt domains established on the pulp board by dipping and drying remain adhered to the fiber and are present in the collected batt after grinding. Other methods for adding the salt solution to the fibers will be evident to those skilled in the art.

As previously stated, it is preferred that the drying of the salt solution on the fibers be rapid so as to promote growth of a multiplicity of small crystals. This is usually accomplished by the use of high temperature air with high air flow. Significant improvement of wettability has, however, been observed in air dried samples.

It is preferred that the salt add-on be between 4 and 12% of the fiber weight. The most preferred add-on is between 6 and 10%.

Wood pulp batts may be prepared by the transverse webber device shown in U.S. Pat. No. 4,927,685, a dual rotor unit as in U.S. Pat. No. 3,768,118 or any other such batt forming device all of which are well known in the art. Staple fiber webs may be prepared by a standard textile carding engine or air laid by any of the web forming units well known to those in the art.

Drying of the salt solution on the fibers to form the discrete salt domains required of this invention may be accomplished in a convection oven, by air drying, by the application of heat as by I. R. heaters or by other methods well known in the art. It is preferred that the drying be at elevated temperature and high air flow so as to promote the formation of small discrete salt domains on the fibers.

BRIEF DESCRIPTION OF THE DRAWINGS

FIG. 1 shows a typical wood pulp batt 2 made up of individualized ground wood pulp fibers 4 with discrete ionic salt domains 6 attached to the surface of the fibers 4.

Figure 2:
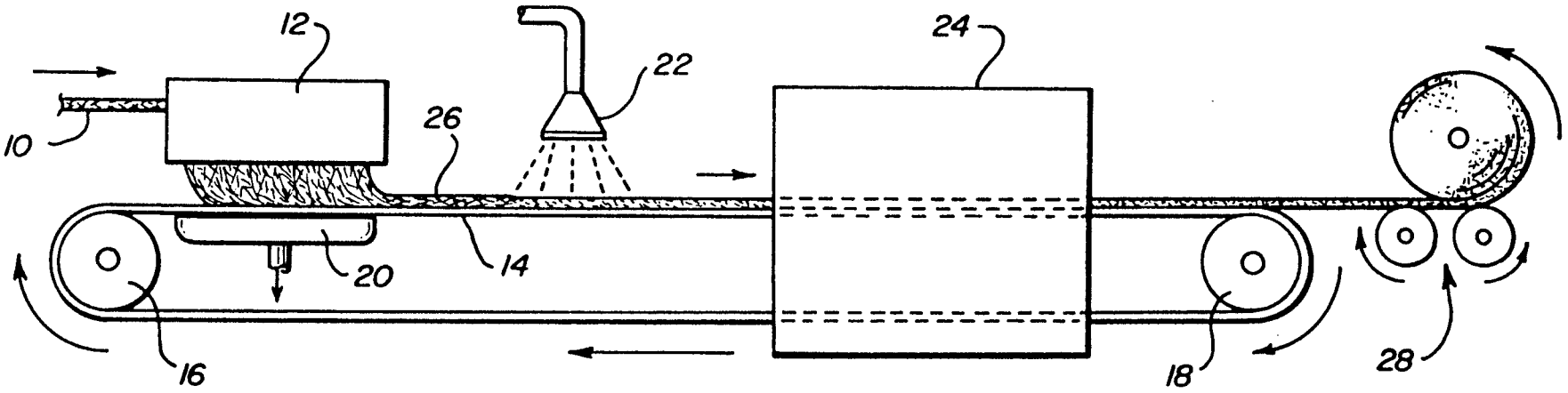
FIG. 2 is a plan view of a typical processing line.

A representation of a method of making the product of this invention is shown in FIG. 2. Pulp board 10 is fed to a transverse webber 12 which individualizes the pulp fiber and deposits the fiber on collecting belt 14. Belt 14 is an open mesh wire belt which passes about rolls 16 and 18 and is driven by a means not shown. Vacuum box 20 is placed beneath belt 14 immediately under the discharge of webber 12 so as to cause an air flow to aid in collecting the fibers. The vacuum box 20 is connected to an air blower (not shown) by a duct (not shown). The belt 14 moves in the direction of the arrow and carries the formed wood pulp fiber batt 26 under the spray nozzle 22. Nozzle 22 applies the salt solution onto the fibrous web. The salt solution is supplied to the nozzle 22 from a reservoir (not shown) by a pump (not shown) and attendant piping. The salt solution wetted web passes into a heated high air velocity convection oven 24 wherein the wetted web is dried leaving small discrete ionic salt domains on the surface of the fibers of the fibrous batt 26. Downstream of the oven the dried batt 26 is removed from the collecting belt 14 and rolled up by the batcher 28.

The following examples illustrate the practice of this invention.

EXAMPLE 1

An air-laid wood pulp fiber batt of about 130 g/cm$^2$ is prepared on a dual rotor webber and is cut into 25 cm × 5 cm strips. An individual strip is weighed and then hung off a digital balance. A solution is sprayed uniformly onto the strip, one face at a time, until the web is uniformly wetted and the liquid add-on (weight of liquid per weight of batt) reaches the desired level. The wet web is then hung to dry and to equilibrate to ambient conditions. The sample is tested in a 60 degree wicking test wherein both the wicking distance and the amount absorbed are recorded. The amount absorbed is expressed as "nominal capacity" which is the measured weight of liquid absorbed divided by the dry weight of the strip. Several samples are prepared as above using different aqueous salt solutions at different salt concentrations. The control sample is not sprayed or dried and is tested for nominal capacity and wicking distance. Another control sample is made by spraying pure water with no salt. The results of the testing are presented in the following table:

| | | 60° Wicking Test | | |
|---|---|---|---|---|
| Solution | Sol/Pulp Add-On | Salt/Pulp Add-On | Nominal Cap g/g | Wicking Distance CM |
| Control | N/A | N/A | 3.6 | 7.9 |
| Water | 1-2:1 | 0% | 3.2 | 7.7 |
| 3% NaCl | 2:1 | 6% | 3.72 | 11.4 |
| 5% NaCl | 2:1 | 10% | 3.9 | 10.5 |
| 6% NaCl | 1:1 | 6% | 3.75 | 10.5 |
| 3% NaCl | 1:1 | 3% | 3.3 | 7.7 |
| 3% KCl | 2:1 | 6% | 3.78 | 11.2 |
| 3% KCl | 1:1 | 3% | 3.45 | 7.3 |

As can be seen from these results, the strips prepared with 6–10% salt add-on all display a significantly improved wicking property and a nominal capacity at least equal to the control.

All add-on data is determined by weight as is the nominal capacity. The 60° wicking test is performed by the technique disclosed in U.S. Pat. No. 4,357,827 which is herein incorporated by reference.

What is claimed is:

1. A method of improving the wettability of cellulosic fibers comprising:

a) collecting individualized dry cellulosic fibers on a collection means, b) applying a solution of ionic salt to said collection of individualized dry cellulosic fibers, and c) drying the wetted fibers so as to form discrete crystal domains of said ionic salt on the surface of said cellulosic fibers.

2. The method of claim 1 wherein said ionic salt solution is applied by spraying.

3. The method of claim 1 wherein the said ionic salt solution is selected from the group consisting of those salts having a cation selected from the group consisting of sodium, potassium, ammonium and lithium and an anion selected from the group consisting of chloride, bromide, fluoride, acetate, benzoate, citrate and salicylate.

4. The method of claim 1 wherein said cellulosic fibers are selected from the group consisting of bagasse, bamboo, cotton, flax, hemp, jute, kapok, ramie, reed, sisal, straw, viscous rayon and wood pulp.

5. The method of claim 1 wherein said cellulosic fibers are staple length fibers..

6. The method of claim 1 wherein said cellulosic fibers are wood pulp fibers.

* * * * *